US011704962B2

(12) United States Patent
Purcell et al.

(10) Patent No.: US 11,704,962 B2
(45) Date of Patent: Jul. 18, 2023

(54) ELECTRONIC PRIZE GAMING APPARATUS

(71) Applicant: John Purcell, Cork (IE)

(72) Inventors: John Purcell, Cork (IE); John Purcell, Jr., Cork (IE); Phillip Purcell, Cork (IE)

( * ) Notice: Subject to any disclaimer, the term of this patent is extended or adjusted under 35 U.S.C. 154(b) by 212 days.

(21) Appl. No.: 17/046,294

(22) PCT Filed: Apr. 9, 2019

(86) PCT No.: PCT/EP2019/058915
§ 371 (c)(1),
(2) Date: Oct. 8, 2020

(87) PCT Pub. No.: WO2019/197385
PCT Pub. Date: Oct. 17, 2019

(65) Prior Publication Data

US 2021/0082236 A1 Mar. 18, 2021

Related U.S. Application Data

(60) Provisional application No. 62/655,278, filed on Apr. 10, 2018.

(30) Foreign Application Priority Data

Apr. 10, 2018 (WO) ..... PCT/EP2018/059178

(51) Int. Cl.
*G07F 17/00* (2006.01)
*G07F 17/32* (2006.01)

(52) U.S. Cl.
CPC ..... *G07F 17/3213* (2013.01); *G07F 17/3223* (2013.01)

(58) Field of Classification Search
None
See application file for complete search history.

(56) References Cited

U.S. PATENT DOCUMENTS 2,077,124 A * 4/1937 Miller ..... A63F 5/043 D21/374
5,775,993 A * 7/1998 Fentz ..... G07F 17/3262 463/31
7,824,252 B1 * 11/2010 Kelly ..... A63F 7/0058 463/16
D631,930 S * 2/2011 Krauss ..... D21/830
(Continued)

*Primary Examiner* — Paul A D'Agostino
(74) *Attorney, Agent, or Firm* — Weber Rosselli & Cannon LLP

(57) ABSTRACT

The present invention discloses a gaming apparatus comprising: a digital screen display mounted on a support, an actuation mechanism arranged for moving the digital screen display around an axis of rotation, at least one position identification member, a position sensing mechanism arranged for at least detecting the position of the prize segments with respect to the at least one position identification member; and a computer system. The computer system arranged for transmitting the electronic prize game digital image and associated prize information for display on the digital screen display, and for detecting, based on the position information obtained from the position sensing mechanism, at least one prize segment associated with the at least one stopping position of the digital display screen.

21 Claims, 9 Drawing Sheets

(56) References Cited

U.S. PATENT DOCUMENTS 8,535,146 B2 * 9/2013 Olsen ..... G07F 17/3211 463/27
8,690,154 B2 * 4/2014 Owoc ..... A63F 5/04 273/142 R
8,974,297 B2 * 3/2015 Massing ..... G07F 17/3216 463/31
9,412,224 B2 * 8/2016 Kido ..... A63F 5/00
9,711,001 B2 * 7/2017 Zedell, Jr. ..... G07F 17/3241
10,373,440 B2 * 8/2019 Basallo ..... G07F 17/3267
10,395,468 B2 * 8/2019 Casey ..... G07F 17/3244
10,672,222 B2 * 6/2020 Urban ..... A47F 5/12
2004/0087357 A1 * 5/2004 Johnson ..... G07F 17/3262 463/17
2006/0038343 A1 * 2/2006 Adams ..... A63F 5/045 273/143 R
2006/0157927 A1 * 7/2006 O'Halloran ..... G07F 17/32 273/143 R
2006/0247023 A1 * 11/2006 Inoue ..... G07F 17/3211 463/20
2006/0247823 A1 * 11/2006 Boucher ..... G07F 9/002 700/241
2007/0054723 A1 * 3/2007 Mattice ..... G07F 17/32 463/16
2007/0054727 A1 * 3/2007 Garamendi ..... G07F 17/34 463/16
2008/0004089 A1 * 1/2008 Huizer ..... H04M 1/6058 455/575.2
2008/0004098 A1 * 1/2008 Bennett ..... G07F 17/3286 463/16
2008/0073842 A1 * 3/2008 Jones ..... A63F 1/18 273/149 R
2008/0113712 A1 * 5/2008 Leblanc ..... G07F 17/32 463/16
2008/0146309 A1 * 6/2008 Bennett ..... G07F 17/3244 463/18
2008/0227530 A1 * 9/2008 LeMay ..... G07F 17/3202 463/22
2010/0120540 A1 * 5/2010 Hirato ..... G07F 17/32 463/47
2010/0327523 A1 * 12/2010 Owoc ..... A63F 5/04 273/142 R
2010/0331070 A1 * 12/2010 Bartosik ..... G07F 17/3213 273/142 E
2011/0059789 A1 * 3/2011 Luciano ..... G07F 17/32 463/20
2011/0081963 A1 * 4/2011 Chongolnee ..... G07F 17/3258 463/30
2012/0061543 A1 * 3/2012 Juan ..... F16M 13/02 248/291.1
2012/0115563 A1 * 5/2012 Kido ..... G07F 17/3211 463/17
2012/0122545 A1 * 5/2012 Watkins ..... G07F 17/3211 463/20
2012/0122571 A1 * 5/2012 DeSimone ..... G07F 17/3211 463/31
2012/0172102 A1 * 7/2012 Gurule ..... A63F 5/00 463/17
2012/0200033 A1 * 8/2012 Owoc ..... A63F 5/046 273/142 JA
2012/0220363 A1 * 8/2012 Bytnar ..... G07F 17/3216 463/25
2013/0143640 A1 * 6/2013 Young ..... G07F 17/3286 463/20
2013/0279090 A1 * 10/2013 Brandt ..... A45C 9/00 361/679.01
2014/0113698 A1 * 4/2014 Rakestraw ..... G07F 17/3239 463/20
2014/0113712 A1 * 4/2014 Van Asdale ..... G07F 17/3255 463/27
2014/0141886 A1 * 5/2014 Woels ..... G07F 17/3216 463/31
2014/0211100 A1 * 7/2014 Massey ..... F16M 11/2014 348/836
2014/0235318 A1 * 8/2014 De Viveiros Ortiz ..... G07F 17/3267 463/19
2014/0246829 A1 * 9/2014 Jones ..... A63F 1/12 273/149 R
2014/0370957 A1 * 12/2014 Hadida ..... A63F 5/00 463/17
2015/0050982 A1 * 2/2015 Brooks ..... G07F 17/3213 463/20
2015/0321082 A1 * 11/2015 Kawabata ..... A63F 5/0076 273/142 E
2016/0005267 A1 * 1/2016 Kawashima ..... G07F 17/3216 463/46
2016/0093154 A1 * 3/2016 Bytnar ..... G07F 17/3237 463/25
2016/0158086 A1 * 6/2016 Schmitt ..... A61H 1/0255 601/27
2016/0260281 A1 * 9/2016 Ashigaya ..... G07F 17/3213
2016/0335854 A1 * 11/2016 Kitamura ..... G07F 17/3267
2017/0087446 A1 * 3/2017 Mercer ..... A63F 5/00
2017/0236382 A1 * 8/2017 Colvin ..... G07F 17/3295 463/17
2019/0072231 A1 * 3/2019 Newville ..... F16M 11/08
2020/0051372 A1 * 2/2020 Chapman ..... A63F 5/045
2021/0247019 A1 * 8/2021 Newville ..... F16M 11/18

* cited by examiner

ELECTRONIC PRIZE GAMING APPARATUS

FIELD

The present invention relates to a gaming apparatus having a rotating digital screen display, more specifically, the present invention aims to provide an electronic prize gaming apparatus that is capable of being operated electronically by means of a computer system and/or manually by an operator, while maintaining the characteristics of a traditional spinning prize wheel apparatus.

BACKGROUND

Mechanical prize gaming apparatuses have been in operation in casinos and similar establishments for a long time. For example, a version of such a mechanical prize gaming apparatus is the "Wheel of Fortune", also called the "Big Six Wheel", which resembles a large wheel having a number of segments each containing prize information. Mechanical prize gaming apparatuses are usually manually operated by an operator in response to receiving bets from players. The operator is responsible for spinning the wheel and for calling out the winning prize segment, which is indicated by a position identification member provided on the prize gaming apparatus. An example of such a mechanical prize gaming apparatus is disclosed in US 2010/0327523.

However, the known mechanical prize gaming apparatuses have a number of drawbacks. For example, the manual operation of the known mechanical prize gaming apparatuses requires an operator to be present at all times, thereby in the absence of an operator the game is shut down, which results in lost revenue for the establishment. Furthermore, the players need to be physically present to place their bets, thereby preventing players to play the game and live the gaming experience from another location, e.g. their home. Moreover, the layout of the current prize gaming apparatuses is configured according to the requirements of a predetermined game, thereby preventing other games to be played on the same apparatus.

SUMMARY OF THE INVENTION

The present invention aims to provide a gaming apparatus that overcomes the drawbacks of the existing solutions. More specifically, the present invention aims to provide an electronic prize gaming apparatus that is capable of being operated electronically by means of a computer system, while maintaining the characteristics of a traditional spinning prize gaming apparatus.

This aim is achieved according to the invention with the gaming apparatus showing the technical characteristics of the first claim.

According to an aspect of the present invention, a gaming apparatus is provided. The gaming apparatus comprises a digital screen display mounted on a support. The digital screen display is configured for displaying a digital image and associated data of an electronic prize game, which electronic prize game divides the digital screen display into prize segments with each segment having associated prize information. The gaming apparatus is provided with an actuation mechanism arranged for moving the digital screen display around an axis of rotation, at least one position identification member for indicating at least one stopping position of the digital screen display, a position sensing mechanism arranged for detecting the position of the prize segments with respect to the at least one position identification member and a computer system. The computer system is arranged for transmitting the electronic prize game digital image and associated prize information for display on the digital screen display, and is arranged for detecting, based on the position information obtained from the position sensing mechanism, at least one prize segment associated with the at least one stopping position of the digital display screen, the computer system being configured for at least transmitting for display to the digital screen display, the prize information associated with the at least one detected prize segment.

It has been found that a gaming apparatus according to the present invention overcomes the drawbacks associated with the known gaming apparatuses previously presented. More specifically, the use of a rotatable digital screen display in combination with a computer system allows for the game layout to be easily reconfigured, thereby allowing other games to be played on the same gaming apparatus. Furthermore, the use of a rotatable digital screen display maintains the traditional character of a mechanical prize gaming apparatus, e.g. Wheel of Fortune. Moreover, the use of a computer system has the advantage that the system can be operated with limited manual intervention by the operator. The computer system may be configured for electronically controlling the operation of the actuation mechanism, e.g. acceleration and/or deceleration of the digital screen display, based on a particular event, e.g. lapsed period from an initial player bet. Furthermore, the computer system is capable with the use of a sensing mechanism for electronically detecting the stopping position of the digital screen display, and further electronically reporting the prize information of the corresponding prize segment to the players that have placed bets, or otherwise selected a prize-winning segment in the case of non-gaming/promotional/fun apparatus. For example, the prize information may include the winning prize associated with the prize segment. Also, the game apparatus may transmit to the user other types of data, e.g. if they have won, the winning amount, the amount left on their account, any other types of information considered by the skilled person in the art. Moreover, the gaming apparatus of the present invention can be connected to other devices over an external communication network, thus allowing a user to interact with the gaming apparatus and play the game from a remote location. For example, a player using an electronic device, e.g. laptop, smartphone, tablet, etc. may interact with the gaming apparatus of the present invention for placing bets and accordingly receiving prize information from their home.

According to embodiments of the present invention, the computer system is arranged for controlling the operation of the actuation mechanism based on an output value of a Random Number Generator (RNG) computer software. The computer system may control, based on the output value of the RNG computer software, the acceleration and/or deceleration of the digital screen display about the rotation axis. For example, the computer system may be configured for calculating, based on the RNG output value, the desired stopping position of the digital screen display, so that the digital screen display stops at a predetermined prize segment indicated by the RNG output value.

It has been found that using the RNG output value to calculate the desired stopping position, provides an advantage in that the system can be operated without any manual intervention. At the same time, the use of an RNG computer software ensures that the stopping position is randomly chosen each time thus preventing a user from predicting the game outcome. The RNG computer software may be loaded with an RNG computer algorithm, e.g. Pseudorandom RNG that generates each time a random output, which is used by the computer system to control the operation of the actuation mechanism. For example, the RNG output value can be used to control using the actuation mechanism, the spin duration and speed of the digital screen display about the rotation axis, so that the digital screen display stops at a predetermined stopping position. The operation of the RNG computer software may be controlled by a user-defined winning pay-out percentage, which can be configured by an administrator locally or remotely from a central control location. In this way, the winning probability can be easily adjusted to the required level.

According to embodiments of the present invention, the actuation mechanism comprises a motor arranged for moving the digital screen display about the rotation axis. As previously discussed, the motor of the actuation mechanism may be operated in response to signals received from the computer system. Furthermore, the actuation mechanism motor may be operated in response to the user pressing a button. The actuation mechanism may be provided with pin members protruding from a frame area surrounding the digital screen display. The pin members may be used by a user to operate the actuation mechanism manually. For example, to enhance the traditional character of the game apparatus, an operator may spin the digital screen display about the rotational axis. According to embodiments of the present invention, the actuation mechanism may comprise at least one handle for manually rotating the digital screen display. For example, the at least one handle may be positioned in the region of the digital screen display frame area. In this way, it becomes easier for the operator to spin the digital screen display. According to embodiments of the present invention, the pin members are configured during the rotation of the digital screen display to interact with the at least one position identification member to progressively slow down the movement of the digital screen until it comes to a standstill. The at least one position identification member may be in the form of a resilient element arranged to bend when it comes in contact with the pin members. Each time, the at least one position identification member comes in contact with a pin member, reduces the speed of the digital screen display about the rotational axis. The position identification member may be in the form of an arrow connected at one end to a surface. For example, the position identification member may be connected to support holding the digital screen display.

It has been found that by providing means for manually spinning and stopping the digital screen display about the rotation axis, has the advantage that the gaming apparatus of the present invention can be operated in different operating modes. For example, the gaming apparatus can be operated manually by an operator, or electronically by the computer system, and/or in a mixed manual/electronic operation mode. In this way, the game apparatus can be continuously operated throughout the day even in the absence of an operator while maintaining the traditional character of the game. At the same time, the gaming apparatus of the present invention has the advantage of allowing the user to play the game remotely.

According to embodiments of the present invention, the digital screen display comprises a transparent screen secured on top of the pin members, and a movable object positioned in the space defined between the digital screen display and the transparent screen.

According to embodiments of the present invention, the dimensions of the movable object are larger than the dimensions of the space defined between each pair of pin members.

According to embodiments of the present invention, the movable object is configured to move with the rotation of the digital screen display.

According to embodiments of the present invention, the stopping position of the movable object denotes a winning prize segment.

It has been found that the provision of a transparent screen on top of the pin member provided on the digital screen display, creates a space which may be used to accommodate a movable object that may be used to denote a wining prize segment. The movable object may be freely move in the space created between the digital screen display and the transparent screen. To ensure that the movable object is maintained within the space created, the movable object is dimensioned such that it is larger than the dimensions of the space defined between the pin members. The movable object may be any one of a ball, a puck, or any other object that is suitable for the purpose. The movable object may be of any suitable shape e.g. round, oval, and the like. The transparent screen may be secured on the pin members by securing means e.g. glue, screws, and the like. The stopping position of the movable object may be used to denote a wining prize segment, and may be used in combination with the position identification member of the previous embodiments.

According to embodiments of the present invention, the actuation mechanism may be provided with an RPM sensor for detecting the rotational speed of the digital screen display about the axis of rotation. For example, the actuation mechanism may be provided with a tachometer. The RPM sensor may be configured for measuring the rate of rotation of the digital screen display about the rotation axis, and for transmitting this information to the computer system. In this way, the computer system is capable of accurately monitoring the speed of the digital screen display about the rotational axis and further detecting when the digital screen display comes to a stop.

According to embodiments of the present invention, the position sensing mechanism may comprise sensors for at least detecting the position and/or orientation of the digital screen display with respect to the position identification member. Furthermore, according to embodiments of the present invention, the plurality of sensors is configured for detecting the stopping position of the movable object. The sensors may be distributed on the digital screen display, and each sensor may be configured for transmitting an electrical signal to the computer system, which may indicate the position and/or orientation of the digital screen display with respect to the position identification member, and/or the stopping position of the movable object. For example, the position sensing mechanism may be provided with a plurality of proximity-based sensors, indicating the position of the position identification member and/or the position of the movable object. Furthermore, the position sensing mechanism may be provided with at least one accelerometer sensor capable of detecting the way the digital screen is pointing with respect to the position identification member. For example, the accelerometer sensor may indicate the way a reference point of the digital screen display is oriented with respect to the position identification member and/or the stopping position of the movable object. Moreover, the position sensing mechanism may be provided with at least one gyroscope configured for detecting the orientation of the digital screen display. Furthermore, the position sensing mechanism may be provided with an image recording device arranged for at least recording the stopping position of the digital screen display and/or the stopping position of the movable object, the image recording being transmitted to the computer system for calculating based on the recorded image the prize segment associated with the stopping position. The image recording device may be a camera, which is capable of recording videos as well as images. The computer system is capable of processing the recording to detect the prize segment associated with the stopping position.

It has been found that the use of the different sensors has the advantage of allowing the gaming apparatus to accurately measure different parameters that may be used to calculate at least the position, and/or speed, and/or orientation of at least the digital screen display, and/or the position identification member, and/or the position of the movable object. The sensors may be integrated at a desired location. For example, the sensors may be distributed on the digital screen display, and/or placed at specific locations on the gaming apparatus e.g. the pin members, handles, or in any other suitable location According to embodiments of the present invention, the support may be provided with an angle adjuster mechanism arranged for adjusting the angle and/or position of the digital screen display on the support. In this way, the rotational axis about which the digital screen display moves can be changed depending on the game being played and/or the position of the players. The digital screen display may rotate about a horizontal axis of rotation. In this way, the gaming apparatus may resemble a "Wheel of Fortune" game. The digital screen display may rotate about a vertical axis of rotation, which may resemble a roulette wheel. Moreover, the digital screen display rotates about an axis of rotation positioned between a vertical axis and a horizontal axis. In this way, the digital screen display rotates on a tilted rotation axis, which may offer a better viewing angle for the players.

According to embodiments of the present invention, the digital screen display may be of any shape and form. For example, the digital screen display may be circular resembling a prize wheel, e.g. Wheel of Fortune, or roulette wheel. Alternatively, the digital screen display may be in a non-circular, e.g. rectangle, square, oval, or even be a non-flat shape, such as conical, hemispherical and the like. These types of screens may also be used for promotional purposes, e.g. in a bar or restaurants, shops, or other establishments.

According to embodiments of the present invention, the support comprises a rotary electrical connector for the transmission of power and/or electrical signals to the digital screen display. For example, the rotary electrical connector may be a slip ring or another device known to the skilled person. The use of a rotary electrical connector allows to continuously supply power and electrical signals from the support to the rotating digital screen device.

According to embodiments of the present invention, the computer system is operatively coupled to a computer server configured for forwarding, via a communication link, the prize information associated with the at least one detected prize to at least one user operated device. For example, the computer system, via the computer server, may be configured for receiving from and communicating information to the user device. The user devices may be in the form of user terminals arranged for accepting bets from the players, which may be positioned locally or remotely from the gaming apparatus. The user device may run a computer software application configured for allowing the user to interact with the gaming apparatus, e.g. placing bets, receiving winning prize information.

BRIEF DESCRIPTION OF THE DRAWINGS

The following drawings are provided as an example to explain further and describe various aspects of the invention.

DETAILED DESCRIPTION

The present invention will be illustrated using the exemplified embodiments shown in the FIGS. 1 to 9, which will be described in more detail below. It should be noted that any references made to dimensions are only indicative and do not restrict the invention in any way. While this invention has been shown and described with reference to certain illustrated embodiments thereof, it will be understood by those skilled in the art that various changes in form and details may be made therein without departing from the scope of the invention encompassed by the appended claims. Furthermore, while the invention has been described with references to a particular gaming apparatus resembling a prize-winning wheel, it should be understood by those skilled in the art that changes in form and details may be made to facilitate other types of gaming apparatuses without departing from the scope of the invention encompassed by the appended claims.

Figure 1:
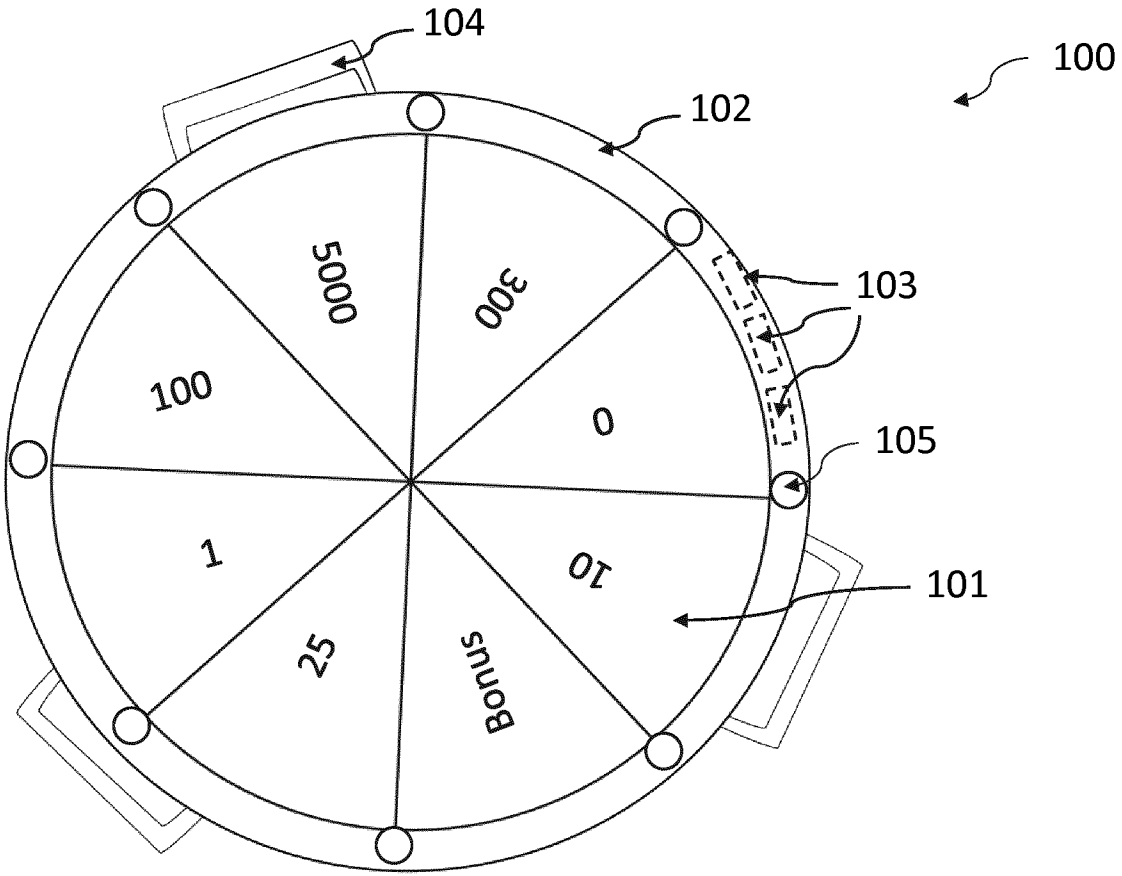
FIGS. 1 and 2 show examples of a digital screen display according to embodiments of the present invention.
Figure 2:
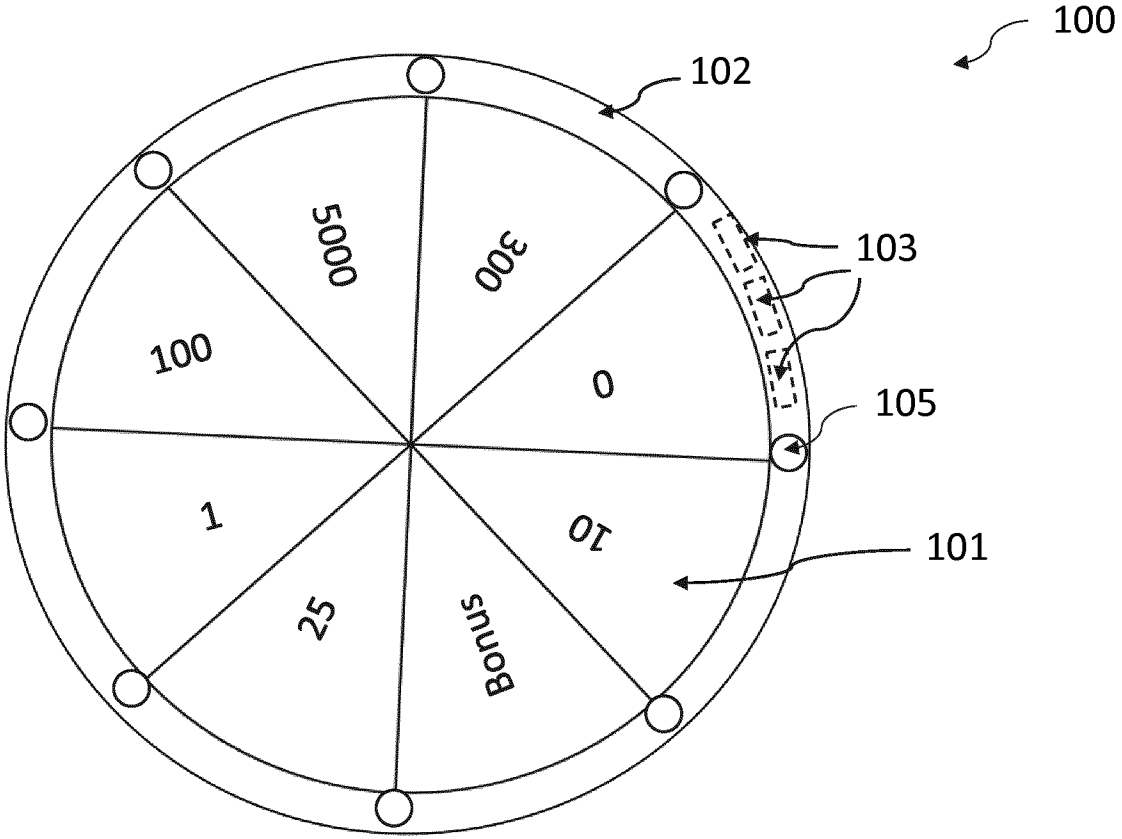

FIGS. 1 and 2 shows examples a digital screen display 100 for use in the gaming apparatus of the present invention. The digital screen displays 100 comprises a display area configured for displaying a digital image and associated data of an electronic prize game. Depending on the game the display area may be divided into a number of prize segments 101, with each segment 101 having associated prize information. For example, as shown in FIGS. 1 and 2, each prize segment 101 may comprise a winning amount, a bonus payment, or any other information required by the game. The digital image and prize information can be reconfigured via a computer system, thereby allowing for multiple games to be played on the same screen. The digital screen displays 100 may be provided with a frame area 102, which may be positioned around the perimeter of the digital screen area. The digital screen display shown in FIG. 1, may be provided with a number of pin members 105, and/or handles 104. The pin members 105 and handles 104 may be part of an actuation mechanism, which may allow the user to manually actuate the digital screen display about a rotation axis. The pin members 105 and the handles 104 may take any shape and form known to the skilled person in the art. The pin members 105 may be used by the user to accelerate the digital screen display 100 about the rotation axis. Furthermore, the pin members 105 may cooperate with at least one position identification member 106 to decelerate the digital screen display 100 after an initial acceleration. The pin members 105 may be positioned at a location on the frame area 102, which enables the user to easily and comfortably spin the digital screen display 100 and further allow from the pin members 105 to cooperate, if needed, with the at least one position identification member 106. The handles 104 may also be positioned at location on the frame area 102, which enables the user to easily and comfortably spin the digital screen display 100. According to embodiments of the present invention, the pin members 105 and handles 104 are only optional, as shown in FIG. 2. For example, the actuation mechanism may comprise a motor, which may be operated by a computer system, for electronically accelerating and decelerating the digital screen display 100 about the rotation axis. Furthermore, the actuation mechanism may combine the pins members 105, and/or handles, and/or the motor. In this way, the digital screen display 100 may be rotated electronically and/or manually. The frame area 102 may house a position sensing mechanism 103, configured for measuring different parameters of the digital screen display. For example, the position sensing mechanism 103 may comprise a range of sensors for at least detecting the position and/or orientation of the digital screen display with respect to the position identification member. The sensors may be positioned at predetermined location around the digital screen display 100 e.g. positioned around the frame area, or in any other desired location. For example, the position sensing mechanism 103 may be provided with any one of or a combination of proximity sensors, accelerometers, infrared sensors, gyroscopes, Revolution Per Minute (RPM) sensors e.g. tachometers, and the like. According to embodiments of the present invention, the position sensing mechanism 103 may be provided with an image recording device arranged for at least recording the stopping position of the digital screen display. The image recording is transmitted to the computer system for calculating based on the recorded image the prize segment associated with the stopping position. The information obtained from the position sensing mechanism 103 may be transmitted in the form of electrical signal, via a wired or wireless connection, to a computer system for further processing. For example, the computer system may use the information obtained to calculate the stopping position of the digital screen display, which may be indicated by the at least one position identification member, and accordingly associate the winning prize segment. The prize information associated with the winning prize segment may be displayed on an area of the digital display screen e.g. the centre, or the entire display area. The digital screen display 100, may be of any shape e.g. circular, rectangular, square, triangular, and the like. Furthermore, the digital screen display 100 may comprise discrete pixel tiles, which are connected together to form a digital screen display of particular shape and dimensions. The digital screen display 100 may be provided with a display controller, which is arranged for controlling each pixel tile so that the desired digital image of the game is formed. The display controller may control the operation of the pixel tiles based on instructions received from a computer system.

Figure 3:
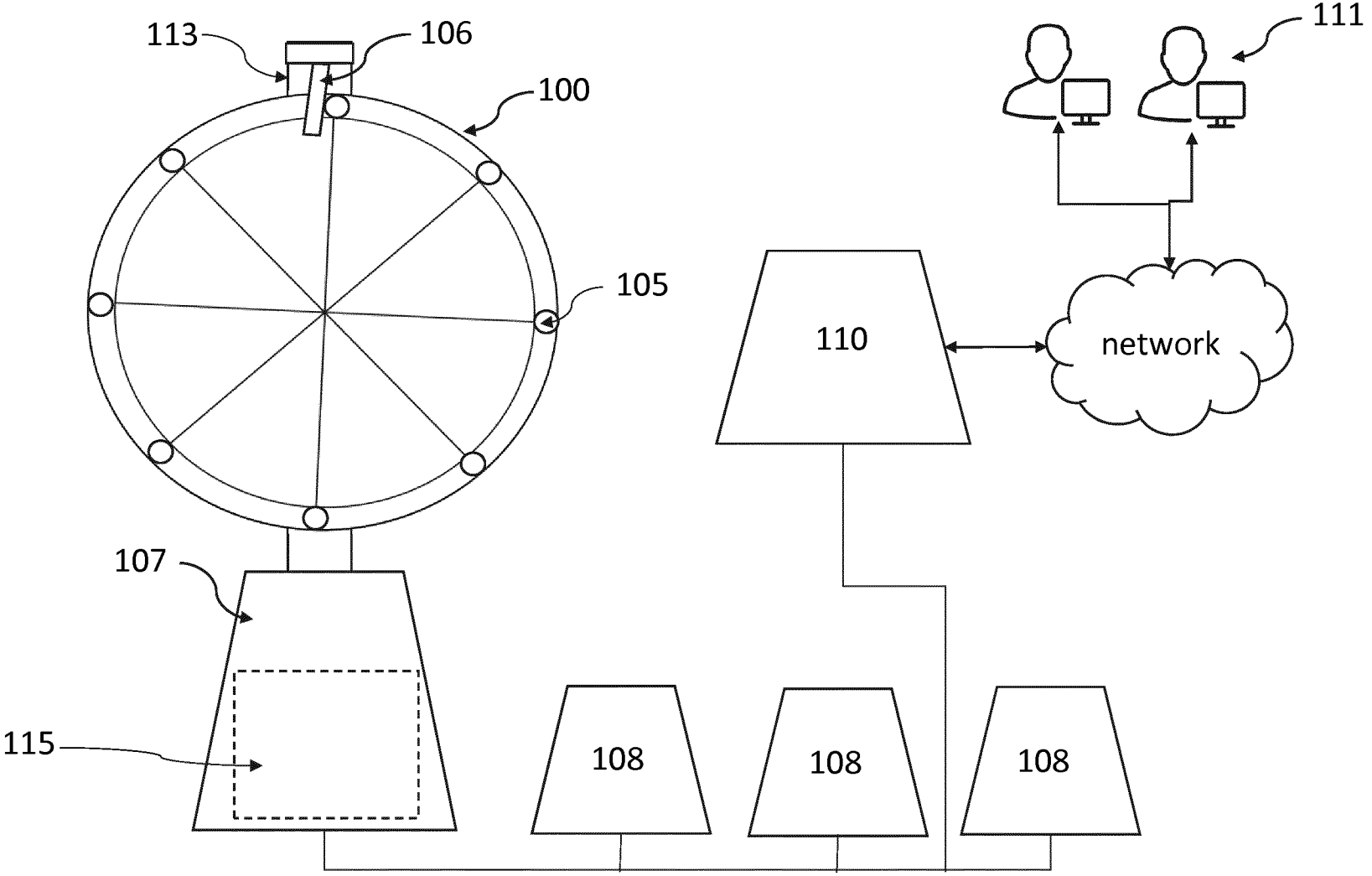
FIG. 3 shows an example of a gaming apparatus according to embodiments of the present invention.
Figure 4:
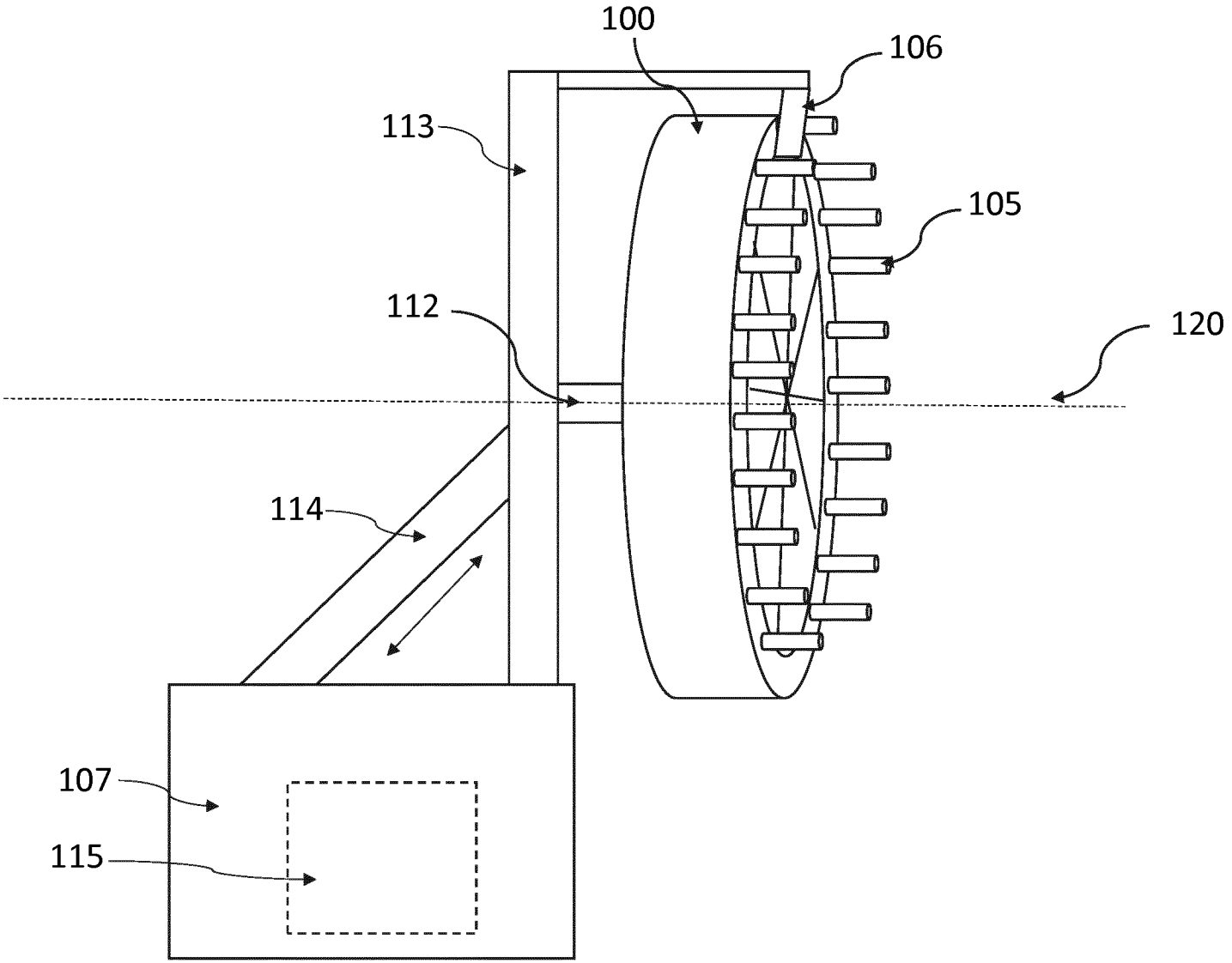
FIG. 4 shows a side view of the exemplified gaming apparatus according to embodiments of the present invention.
Figure 5:
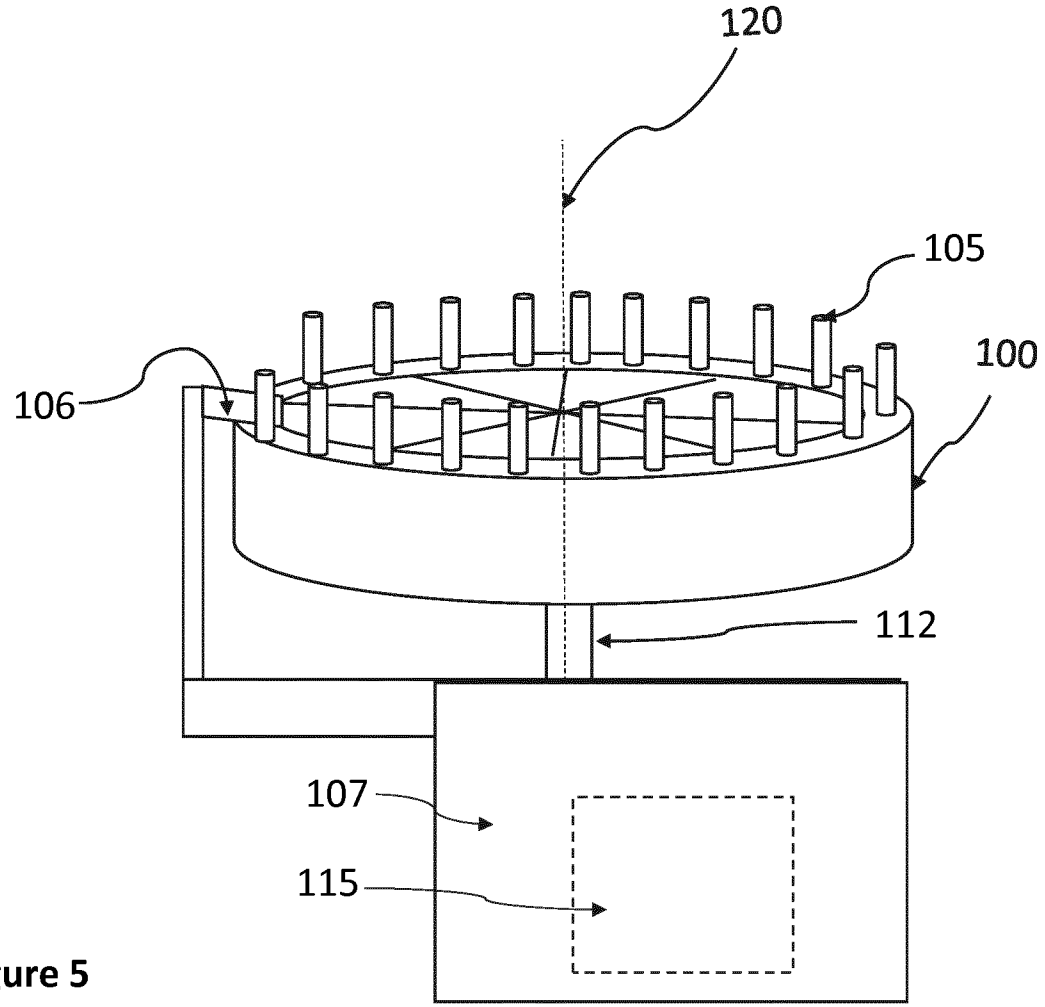
FIGS. 5 and 6 show examples of the gaming apparatus shown in FIG. 4 positioned at different angles according to embodiments of the present invention.
Figure 6:
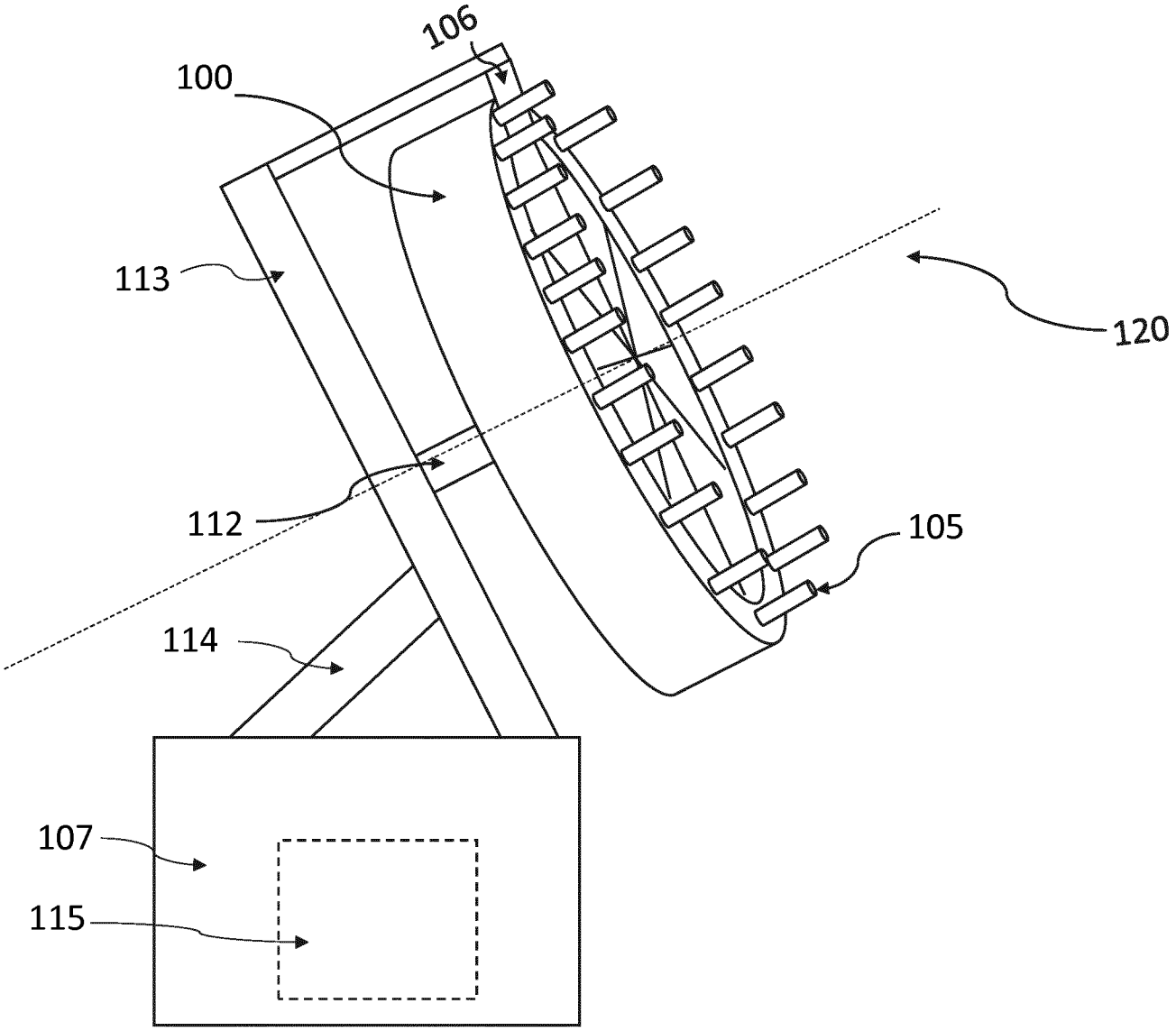

FIG. 3 shows an example of a gaming apparatus according to embodiments of the present invention. The gaming apparatus may incorporate the digital screen display 100 as shown in FIGS. 1 and 2. As an example, the gaming apparatus of FIG. 3, is provided with the digital screen display 100 shown in FIG. 1. However, it should be understood that the gaming apparatus of the present invention may be equally provided with the digital screen display 100 as shown in FIG. 2. According to embodiments of the present invention, the gaming apparatus shown in FIG. 3 can be operated both in manual and/or electronic mode. The digital screen display 100 may be mounted on a support, which may comprise at least a base 107, a supporting arm 113, and a screen connecting member. The screen connecting member 112 may be fitted with a motor e.g. electric motor, for moving the digital screen display 100 about the rotating axis 120, as shown in FIGS. 4 to 6. A rotary connector e.g. a slip ring, may be used to connect the screen connecting member 112 to the digital screen display 100, to allow the continuous operation of the digital screen display 100 during rotation. The motor may be part of the actuation mechanism and may be controlled by the computer system according to embodiments of the present invention. At least one position identification member 106 may be secured at one end to the support structure e.g. at a location on the supporting arm 113. As previously discussed, the at least one position identification member 106 may interact with the pin members 105 provided on the digital screen display 100 to progressively slow down the movement of the digital screen until it comes to a standstill. According to embodiments of the present invention, more than one position identification members 106 may be provided. For example, the players may be able to place bets on the outcome of each position identification member. To facilitate the positioning of a plurality of position identification members the support 113 may be provided with additional supporting members. The at least one position identification member 106 may be in the form of a resilient element arranged to bend when it comes in contact with the pin members 105. Each time, the at least one position identification member 106 comes in contact with a pin member, the speed of the digital screen display about the rotational axis is reduced. The position identification member 106 may be in the form of a flap, an arrow, or any other desired form and shape. The gaming apparatus of the present invention may be provided with a computer system 115, which may be positioned in the base 107 of the support structure, or in another desired location. The computer system 115 may be configured for transmitting the electronic prize game digital image and associated prize information for display on the digital screen display 100. The computer system 115 may be coupled to a number of user terminals, which may be used by the player to place bets. The computer system 115 upon receiving the player bets, may initiate either manually or electronically the spinning of the digital screen display 100. For example, the computer system may alert the operator that all bets have been placed and that the spinning of the digital screen display 100 may begin. Alternatively, the computer system 115, may trigger the motor of the actuation mechanism 112. Once the digital screen display 100, after an initial acceleration, comes to a full stop, the computer system may receive the information obtained from the sensing mechanism 103 to determine the prize segment 101 associated with the stopping position indicated by the at least one position identification member 106. Accordingly, the computer system 115 may be configured for at least transmitting for display to the digital screen display 100 and/or the user terminals 108, the prize information associated with the at least one detected prize segment 101. The computer system 115 may further provide to the user terminals 108 additional information e.g. the amount won by each player based on their initial bet, the amount left on their account, or any other type of information. The computer system 115 may further be coupled to a central computer server 110, which may be connected via a communication link to a number of remote user devices 111. For example, the computer system 115, via the computer server 110, may be configured for receiving from and communicating information to the remote user devices 111. The remote user devices 111 may be user terminals arranged for accepting bets from the players. The remote user devices 111 may run a computer software application configured for allowing the user to interact with the gaming apparatus, e.g. placing bets, receiving winning prize information. Furthermore, the central computer server 110 may be configured for controlling and monitoring the operation of the computer system 115. For example, the central computer server 110 may provide to and collect from the computer system 115 a range of information e.g. provide the game image to be displayed and associated game rule information, decide pay-out percentage, collect bets, facilitate communication with external remote users, etc.

According to embodiments of the present invention, the computer system is operatively coupled to a computer server configured for forwarding, via a communication link, the prize information associated with the at least one detected prize to at least one user operated device. For example, the computer system, via the computer server, may be configured for receiving from and communicating information to the user device. The user devices may be user terminals arranged for accepting bets from the players, which may be positioned locally or remotely from the gaming apparatus. The user device may run a computer software application configured for allowing the user to interact with the gaming apparatus, e.g. placing bets, receiving winning prize information.

FIGS. 4 to 6 show side views of an exemplified gaming apparatus with the digital screen display 100 being positioned at different angles according to embodiments of the present invention. The gaming apparatus presented in FIGS. 4 to 6 is the same as the one presented in FIG. 3, with the only difference being that the digital screen display of FIG. 2 has been used instead. According to embodiments of the present invention, the support structure may comprise an angle adjuster mechanism 114, which allows for positioning the digital screen display 100 at different angles. For example, in FIG. 4 the digital screen display is configured to rotate about a horizontal rotation axis 120. In FIG. 5, the angle of the digital screen display 100 has been adjusted so that the digital screen display 100 rotates about a vertical rotation axis 120. In FIG. 6, the angle of the digital screen display 100 has been adjusted so that it rotates about a rotation axis that is between the horizontal and vertical axis. According to embodiments of the present invention, the rotational angle of the digital screen display 100 may be adjusted over a wide range. The angle adjuster mechanism 114 may be manually operated by an operator and/or electronically by the computer system 115.

Figure 7:
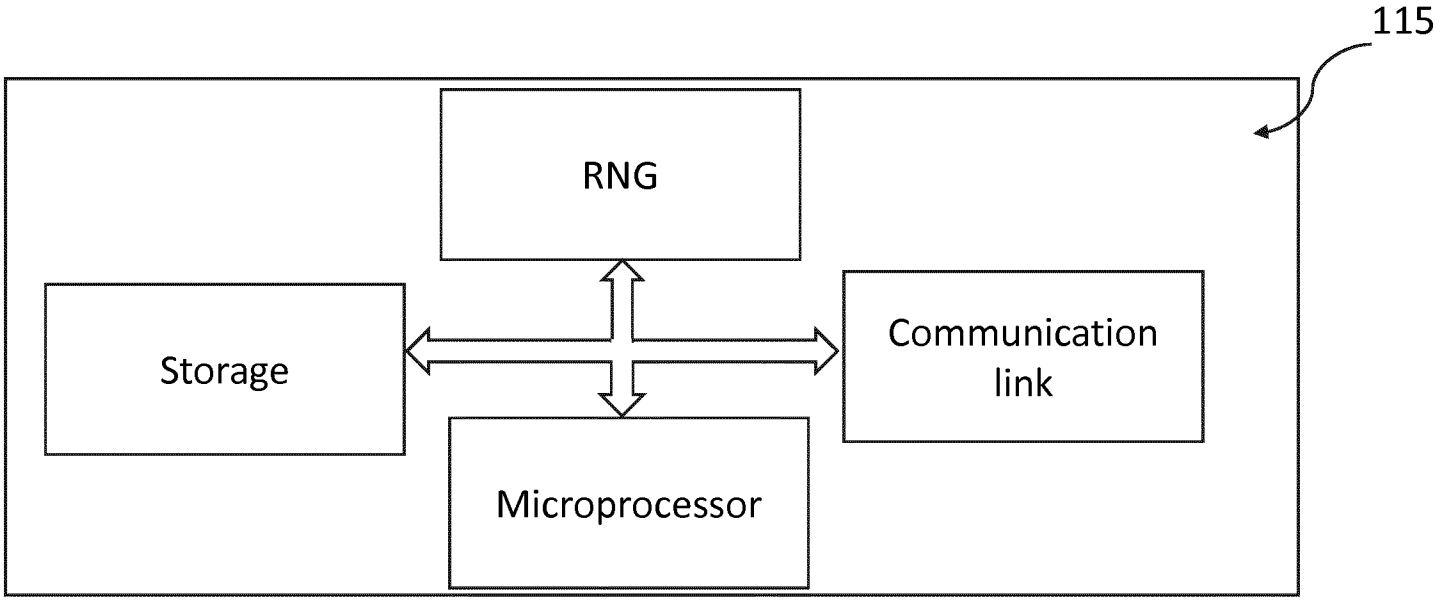
FIG. 7 shows an exemplified implementation of the computer system according to embodiments of the present invention.

FIG. 7 shows an exemplified implementation of a computer system according to embodiments of the present invention. The computer system 115 may comprise a number of different modules. For example, the computer system may comprise a communication link capable of receiving from and transiting information from the different elements of the gaming apparatus of the present invention, e.g. sensors, digital screen display, etc. At least one storage module, which may be loaded with computer software program instructions for running the gaming apparatus, electronic prize game digital images, and may further be configured for storing other types of information, e.g. information obtained from the sensors, bets received by the users, and the like. The computer system 115 may be provided with a microprocessor configured for executing the computer software program instructions, and accordingly, process the information received from the sensors and user terminals. The computer system 115 may further comprise a Random Number Generator (RNG) module which is configured for generating an RNG output value that can be used by the microprocessor to calculate each time the desired stopping position of the digital screen display 100. According to embodiments of the present invention the computer system is arranged for controlling the operation of the actuation mechanism based on an output value of a Random Number Generator (RNG) computer software. For example, the computer system 115 may control, based on the output value of the RNG computer software, the acceleration and/or deceleration of the digital screen display about the rotation axis, so that the digital screen display stops at a predetermined prize segment indicated by the RNG output value. It should be noted that the computer system 115 may comprise a range of other modules that have not been described here.

Figure 8:
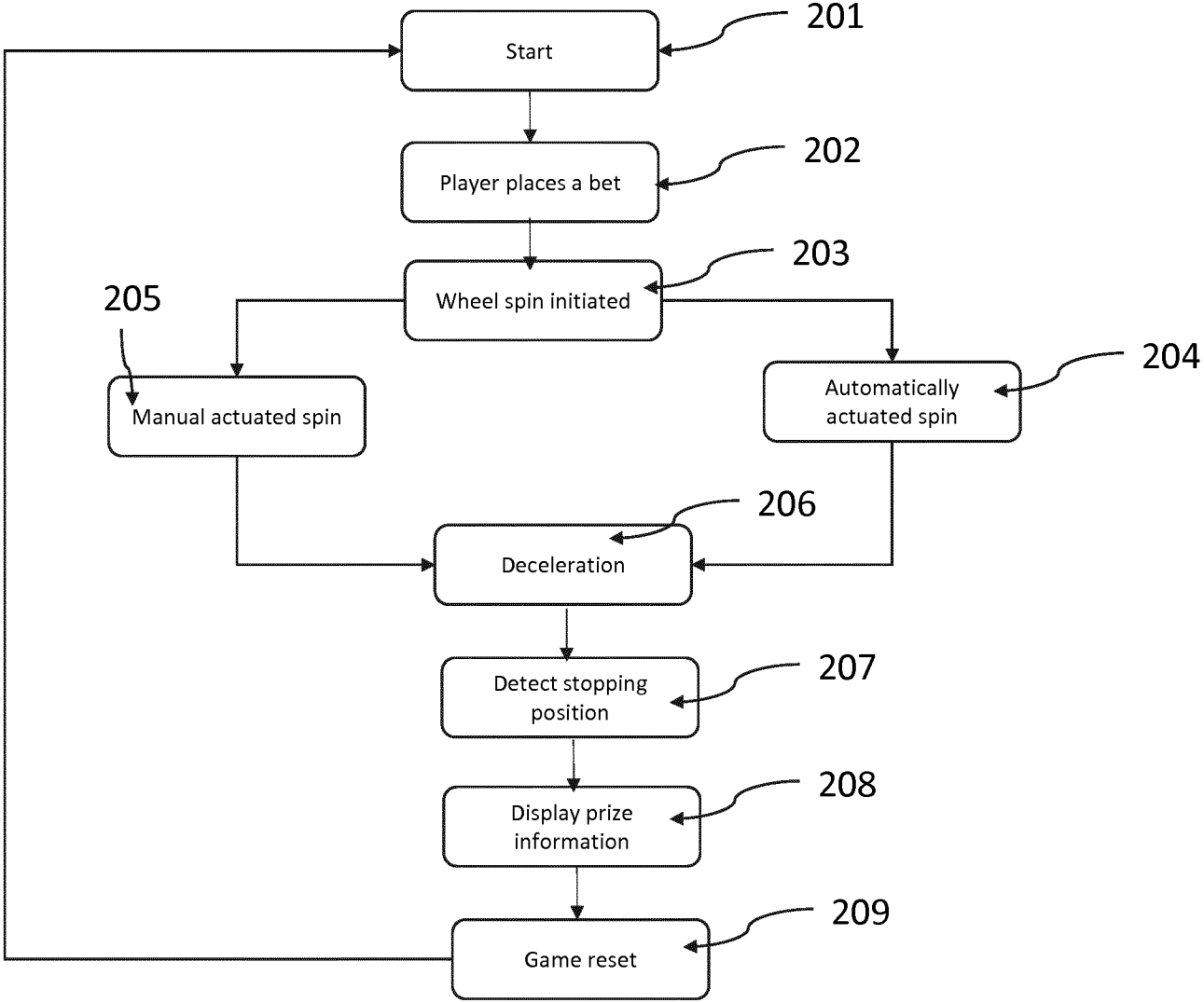
FIG. 8 shows an example of a method showing the process steps followed by the gaming apparatus according to embodiments of the present invention.
Figure 9:
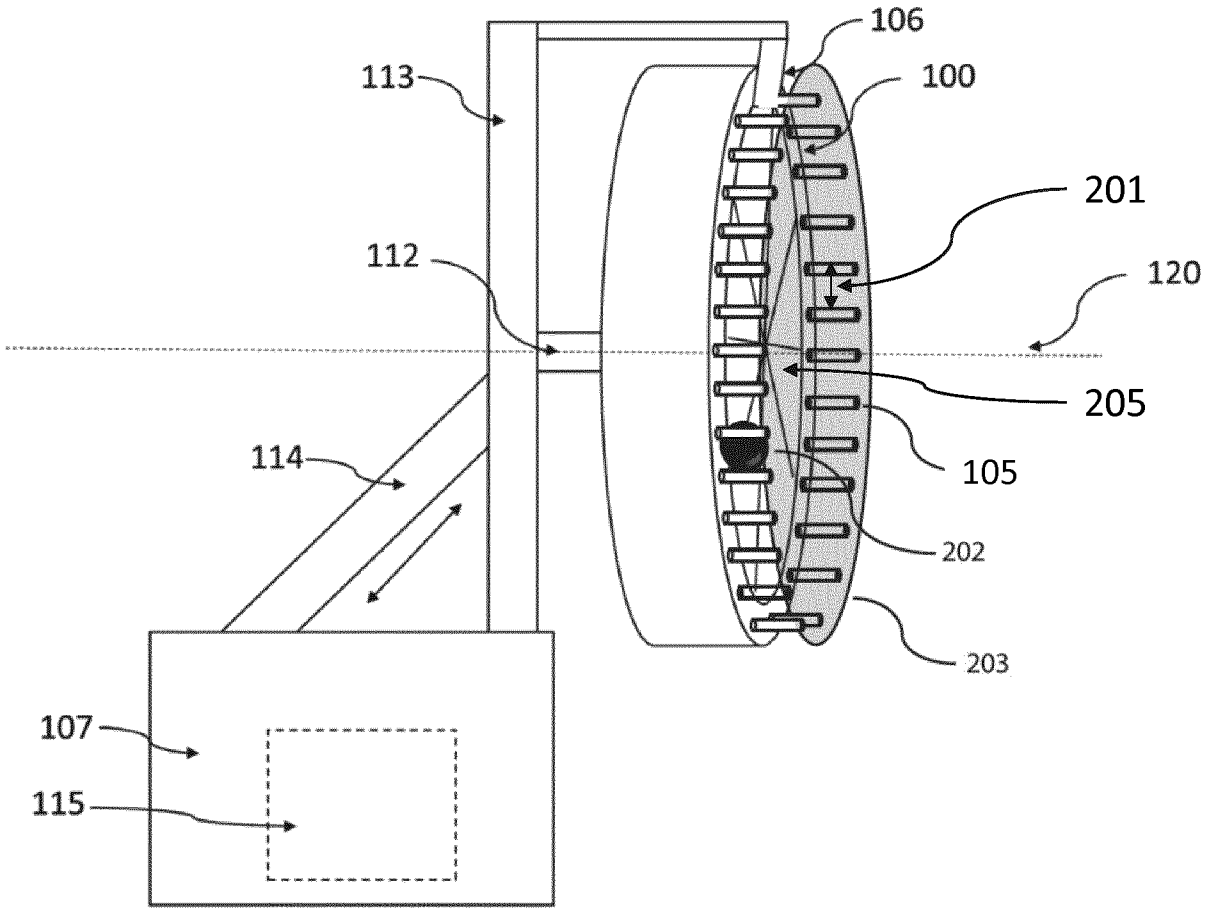
FIG. 9 shows an example of a gaming apparatus with a transparent screen according to embodiments of the present invention.

FIG. 8 shows an exemplified method for operating the gaming apparatus according to embodiments of the present invention. The method may comprise the following steps:

a) Step 201: The computer system 115 receives an intent from a player to play the game. For example, the player may signify its intent by pressing a button on the user terminal 108 or remote user devices 111.

b) Step 202: The player places a bet, and the computer system 115 receives the associated information. For example, the user also referred to as player or customer, may place a bet by interacting with computer application software running on a web-browser, a user device, or a local game terminal. The user may also place a bet on a table with denoted areas of prize wins physically displayed on the table and/or electronically inlaid on the table. Furthermore, the user may interact with the operator of the gaming apparatus to place its bets, and accordingly, the operator may register its intention on the computer system 115 or manually record the predicted win segment on a table, chart or the like.

c) Step 203: Once all players have placed their bets, the digital screen display starts to spin around the desired rotation axis. The wheel spin may be initiated manually by an operator using the pin members 105 and/or handles 104, or it can be initiated electronically by the computer system 115.

d) Step 204: After an initial acceleration, e.g. induced manually or electronically, the digital screen display 100 starts decelerating. As previously discussed, the deceleration may be performed either naturally (step 205) or in an electronically controlled manner (step 206). In the natural deceleration, the digital screen display 100 stops at a random point by decelerating from natural resistance of the at least one position identification member 106, e.g. flapper. In the electronically controlled deceleration, the digital screen display 100 comes to a stop by controlled deceleration of the at least one position identification member 106 and motor of the actuation mechanism. The electronically controlled deceleration may be based on a winning pay-out percentage calculation obtained from the output value of the RNG module.

e) Step 207: Once the digital screen display 100 stops, the stopping position and associated prize segment indicated by the at least one position identification member is detected. This can be done manually by an operator if present or electronically by the computer system 115 based on the information obtained by the sensors.

f) Step 208: The prize segment information from the detected prize segment is displayed to the players. Additional information may be further displayed to the user, e.g. winning amount for each player. Furthermore, the account of each player may be updated depending on the prize segment.

g) Step 209: All players have received the prize information the game is reset, and the process is repeated FIG. 9 shows an example of a gaming apparatus as described with reference to the previous figures incorporating a transparent screen 203 and a movable object 202. As shown in the FIG. 9, the transparent screen 203 may be secured on top of the pin members 105. The pin members 105 may be considered as forming a mounting mechanism. However, it should be noted that other means for provided a mounting mechanism may be used e.g. a continuous or discontinuous wall surrounding the perimeter of the digital screen display, or any other means known to the skilled person in the art. The space 205 defined between the digital screen 100 and the transparent wall 203 may be of a height similar to the height of the mounting mechanism, which in this embodiment is formed by the pin members 105. A movable object 202 e.g. a ball, a puck, or the like, may be positioned within the space 205 created between the digital screen display 100 and the transparent screen 203. The movable object 202 may be dimensioned such that it is free to move with the space 205 as the digital screen display 100 is rotated around the rotation axis 120. The movable object may further be dimensioned such that it larger than the space 201 defined between the pin members 105 of the mounting mechanism, such that the moveable object 202 is prevented from being escape from the space 205 define between the digital screen display 100 and the transparent screen 203. The rotation of the digital screen display 200 causes the movable object to move within the space 205. When the digital screen display comes to a stop, the movable object 202 may come to stop at a location on the mounting mechanism. The stopping position of the movable object may be used to denote a wining prize section. As with previous embodiments, once the stopping position of the movable object 202 is detected by the position sensing mechanism 103, the prize-winning information is transmitted for display to the digital screen display 100 and/or user devices 108, 111. The stopping position of the movable object may be defined by the pin members 105 on which the movable object 202 would come to rest after the digital screen display 100 has stopped spinning. Furthermore, the screen display may be provided with segments, not shown, that may be arranged to trap the movable object e.g. holes, roulette type pocket, and the like. The position sensing mechanism 103 may be used to detect the position of the movable object on the digital screen display 100. For example, the sensors of the position sensing mechanism 103 may be activated by the presence of the movable object e.g. if the position of the movable object has not changed for a predetermined period, or via the processing of an image or video captured by an image recording device. Depending on the configuration of the mounting mechanism, the sensors of the position sensing mechanism may be positioned on predetermined locations on the digital screen display 100 and/or on the mounting mechanism. For example, sensors may be positioned near or on the pin member 105, or may be placed near or in the holes or pockets of the mounting mechanism to detect the presence of the movable object 202.

In general, the routines executed to implement the embodiments of the invention, whether implemented as part of an operating system or a specific application, component, program, object, module or sequence of instructions, or even a subset thereof, may be referred to herein as "computer program code," or simply "program code." Program code typically comprises computer readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer readable program instructions for carrying out operations of the embodiments of the invention may be, for example, assembly language or either source code or object code written in any combination of one or more programming languages.

The program code embodied in any of the applications/modules described herein is capable of being individually or collectively distributed as a program product in a variety of different forms. In particular, the program code may be distributed using a computer readable storage medium having computer readable program instructions thereon for causing a processor to carry out aspects of the embodiments of the invention.

Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. A computer readable storage medium should not be construed as transitory signals per se (e.g., radio waves or other propagating electromagnetic waves, electromagnetic waves propagating through a transmission media such as a waveguide, or electrical signals transmitted through a wire). Computer readable program instructions may be downloaded to a computer, another type of programmable data processing apparatus, or another device from a computer readable storage medium or to an external computer or external storage device via a network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions/acts specified in the flowcharts, sequence diagrams, and/or block diagrams. The computer program instructions may be provided to one or more processors of a general purpose computer, special purpose computer, or other programmable data processing apparatus to produce a machine, such that the instructions, which execute via the one or more processors, cause a series of computations to be performed to implement the functions and/or acts specified in the flowcharts, sequence diagrams, and/or block diagrams.

In certain alternative embodiments, the functions and/or acts specified in the flowcharts, sequence diagrams, and/or block diagrams may be re-ordered, processed serially, and/or processed concurrently without departing from the scope of the invention. Moreover, any of the flowcharts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While all of the invention has been illustrated by a description of various embodiments and while these embodiments have been described in considerable detail, it is not the intention of the Applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicants general inventive concept.

The invention claimed is:

1. A gaming apparatus comprising:

a digital screen display mounted on a support, the digital screen display being configured for displaying a digital image and associated data of an electronic prize game, which electronic prize game divides the digital screen display into prize segments with each prize segment having associated prize information;

an actuation mechanism arranged for moving the digital screen display around an axis of rotation;

at least one position identification member for indicating at least one stopping position of the digital screen display;

a position sensing mechanism arranged for at least detecting a position of the prize segments with respect to the at least one position identification member, wherein the position sensing mechanism comprises:

a plurality of sensors for detecting a stopping position of a movable object; and an image recording device arranged for:

at least recording a stopping position of the digital screen display, a recording image being transmitted to a computer system for identification of the prize segment associated with the at least one position identification member; and at least recording the stopping position of the movable object, a recording image being transmitted to the computer system for identification of the prize segment associated with the stopping position of the movable object; and a computer system operatively coupled to a computer server arranged for transmitting the digital image and associated prize information for display on the digital screen display, the computer system being arranged for detecting, based on position information obtained from the position sensing mechanism, at least one prize segment associated with the at least one stopping position of the digital display screen, the computer system being configured for at least transmitting for display to the digital screen display and/or user devices, prize information associated with the at least one prize segment, wherein the position sensing mechanism comprises a plurality of sensors for at least detecting a position and/or an orientation of the digital screen display with respect to the position identification member.

2. The gaming apparatus of claim 1, wherein the computer system is arranged for controlling operation of the actuation mechanism based on an output value of a Random Number Generator (RNG) computer software.

3. The gaming apparatus of claim 2, wherein the computer system is configured for calculating, based on the output value, the stopping position of the digital screen display.

4. The gaming apparatus of claim 3, wherein operation of the RNG computer software is controlled by a user-defined winning payout percentage.

5. The gaming apparatus of claim 1, wherein the actuation mechanism comprises a motor.

6. The gaming apparatus of claim 1, wherein the actuation mechanism comprises pin members protruding from a frame area surrounding the digital screen display.

7. The gaming apparatus of claim 6, wherein the digital screen display is manually operated by a user via the pin members.

8. The gaming apparatus of claim 7, wherein the pin members are configured during the rotation of the digital screen display to interact with the at least one position identification member to progressively slow down movement of the digital screen display until it comes to a standstill.

9. The gaming apparatus of claim 8, wherein the at least one position identification member is in a form of a resilient element arranged to bend when it comes in contact with the pin members.

10. The gaming apparatus of claim 6, wherein the digital screen display comprises a transparent screen secured on top of the pin members, and a movable object positioned in a space defined between the digital screen display and the transparent screen.

11. The gaming apparatus of claim 10, wherein dimensions of the movable object are larger than dimensions of a space defined between each pair of pin members.

12. The gaming apparatus of claim 11, wherein movable object is configured to move with the rotation of the digital screen display.

13. The gaming apparatus of claim 12, wherein the stopping position of the movable object denotes a winning prize segment.

14. The gaming apparatus of claim 1, wherein the actuation mechanism comprises at least one handle for manually rotating the digital screen display.

15. The gaming apparatus of claim 1, wherein the actuation mechanism comprises an RPM sensor for detecting rotational speed of the digital screen display about the axis of rotation.

16. The gaming apparatus of claim 1, wherein the support comprises a rotary electrical connector for transmitting power and/or electrical signals to the digital screen display.

17. The gaming apparatus of claim 16, wherein the rotary electrical connector comprises a slip ring.

18. The gaming apparatus of claim 1, wherein the digital screen display has a circular shape resembling a prize wheel.

19. The gaming apparatus of claim 1, wherein the digital screen display has a non-circular shape.

20. The gaming apparatus of claim 1, wherein the sensors are distributed on the digital screen display.

21. The gaming apparatus of claim 1, wherein the sensors are any one of or a combination of proximity-based sensors, accelerometers, gyroscopes, and the like.

* * * * *